US006581256B2

(12) United States Patent
Liu

(10) Patent No.: US 6,581,256 B2
(45) Date of Patent: Jun. 24, 2003

(54) DOUBLE-BOW SHOE LACE DEVICE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/920,965

(22) Filed: Aug. 3, 2001

(65) Prior Publication Data

US 2003/0024083 A1 Feb. 6, 2003

(51) Int. Cl.[7] ..... A43C 7/00
(52) U.S. Cl. ..... 24/712.2; 24/712.5
(58) Field of Search ..... 24/115 G, 712–712.9; 36/50.1

(56) References Cited

U.S. PATENT DOCUMENTS 743,924 A * 11/1903 Pratt
2,869,204 A * 1/1959 Mopps
4,393,550 A * 7/1983 Yang et al.
4,680,835 A * 7/1987 Horng
5,097,573 A * 3/1992 Gimeno
6,178,606 B1 * 1/2001 Glendon
6,237,252 B1 * 5/2001 Cook
6,334,240 B1 * 1/2002 Li

FOREIGN PATENT DOCUMENTS

GB 2343701 A * 5/2000

* cited by examiner

*Primary Examiner*—James R. Brittain
(74) *Attorney, Agent, or Firm*—Foley & Lardner

(57) ABSTRACT

A double-bow shoe lace device for a shoe includes a shoe lace, a clamp member, a decorative knot, and a pair of pull members. The shoe lace has a first lace segment adapted to be strung on the shoe, and a second lace segment that includes first and second lace portions. The lower ends of the lace portions are anchored on eyelet tabs of the shoe. The clamp member is sleeved slidably on the lace portions. Downward and upward movements of the clamp member along the lace portions result in tightening and loosening of the shoe. The lace portions are anchored on the clamp member to form a pair of loops. The knot is positioned on the clamp member, and has a pair of distal lace ends. Each of the pull members is mounted slidably on a respective one of the loops.

5 Claims, 9 Drawing Sheets

DOUBLE-BOW SHOE LACE DEVICE

BACKGROUND OF THE INVENTION

1. Field of the Invention

The invention relates to a shoe lace device, more particularly to a double-bow shoe lace device for a shoe.

2. Description of the Related Art

Referring to FIG. 1, a conventional shoe lace device 1 of a shoe 4 includes a shoe lace 2 having first and second lace sections 201, 202, and a clamp member 3. The first lace section 201 is strung on a shoe body 41 so as to form a criss-cross pattern on eyelet tabs 5 of the shoe body 41. The second lace section 202 is formed as a simple loop, and has lower ends 2021 connected to the first lace section 201, thereby anchoring the lower ends 2021 on the eyelet tabs 5, respectively. The clamp member 3, as shown in FIG. 2, includes an elongate casing 301, a clamping block 302, and a spring member 303. The elongate casing 301 is formed with a lateral open end 3010 for receiving the clamping block 302, a closed end 3011 opposite to the open end 3010, and a vertically extending hole unit 301' for extension of the lower ends 2021 of the second lace section 202 therethrough. The clamping block 302 is slidably received in the open end 3010 of the casing 301, and is formed with a vertically extending slot unit 3021 that corresponds to the hole unit 301' of the casing 301 for extension of the lower ends 2021 of the second lace section 202 therethrough. The spring member 303 is disposed in the casing 301, and has opposite ends that abut respectively against the clamping block 302 and the closed end 3011 of the casing 301. As such, the clamping block 302 is biased by the spring member 303 so as to misalign the slot unit 3021 from the hole unit 301' in order to clamp the second lace section 202 between the clamping block 302 and the casing 301.

To tighten the shoe 4, the clamp member 3 is forced to move downwardly along the second lace section 202, thereby bringing the lower ends 2021 of the second lace section 202 closer together.

To loosen the shoe 4, the clamping block 302 is operated to align the slot unit 3021 with the hole unit 301' against action of the spring member 303, and the clamp member 3 is then moved upwardly along the second lace section 202, thus permitting the lower ends 2021 of the second lace section 202 to move away from each.

Although the aforesaid shoe lace device 1 is easy to use, the simple loop configuration of the second lace section 202 has an unattractive appearance.

SUMMARY OF THE INVENTION

Therefore, the main object of the present invention is to provide a double-bow shoe lace device for a shoe.

Accordingly, a double-bow shoe lace device of this invention is adapted for use with a shoe having a pair of eyelet tabs. The shoe lace device comprises a shoe lace, a clamp member, a decorative knot, and a pair of pull members. The shoe lace has first and second lace segments. The first lace segment is adapted to be strung on the shoe so as to form a criss-cross pattern on the eyelet tabs. The second lace segment includes first and second lace portions. Each of the first and second lace portions has a lower end connected to the first lace segment so as to be adapted to be anchored on a respective one of the eyelet tabs. The clamp member is sleeved slidably on the first and second lace portions. Downward movement of the clamp member along the first and second lace portions brings the lower ends of the first and second lace portions closer together for tightening the shoe. Upward movement of the clamp member along the first and second lace portions permits the lower ends of the first and second lace portions to move away from each other for loosening the shoe. Each of the first and second lace portions is anchored on the clamp member to form a pair of loops. The decorative knot is positioned on the clamp member, and has a pair of distal lace ends that extend from the knot. Each of the pull members is mounted slidably on a respective one of the loops.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
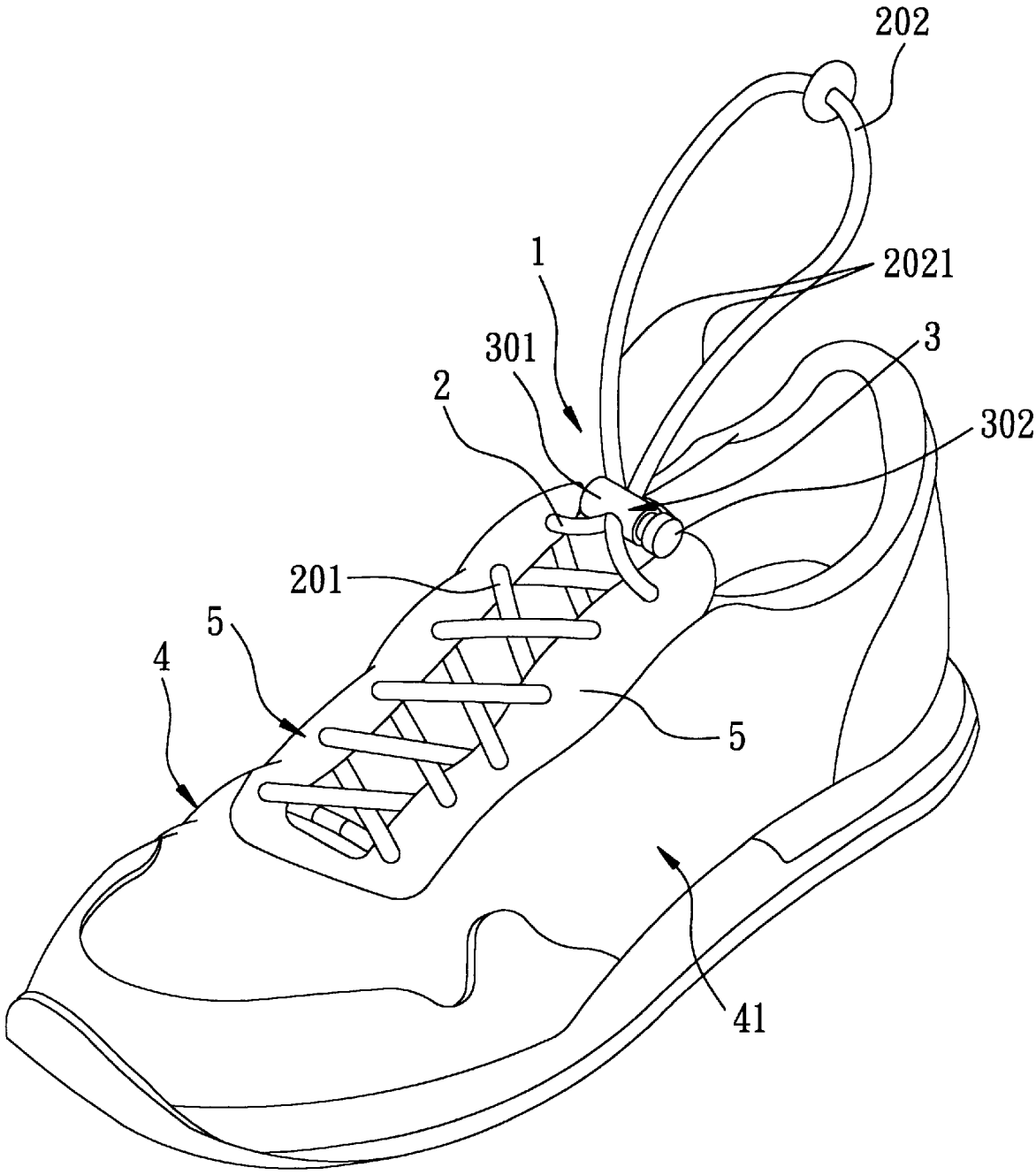
FIG. 1 PRIOR ART
FIG. 1 is a perspective view of a shoe with a conventional shoe lace device.
Figure 2:
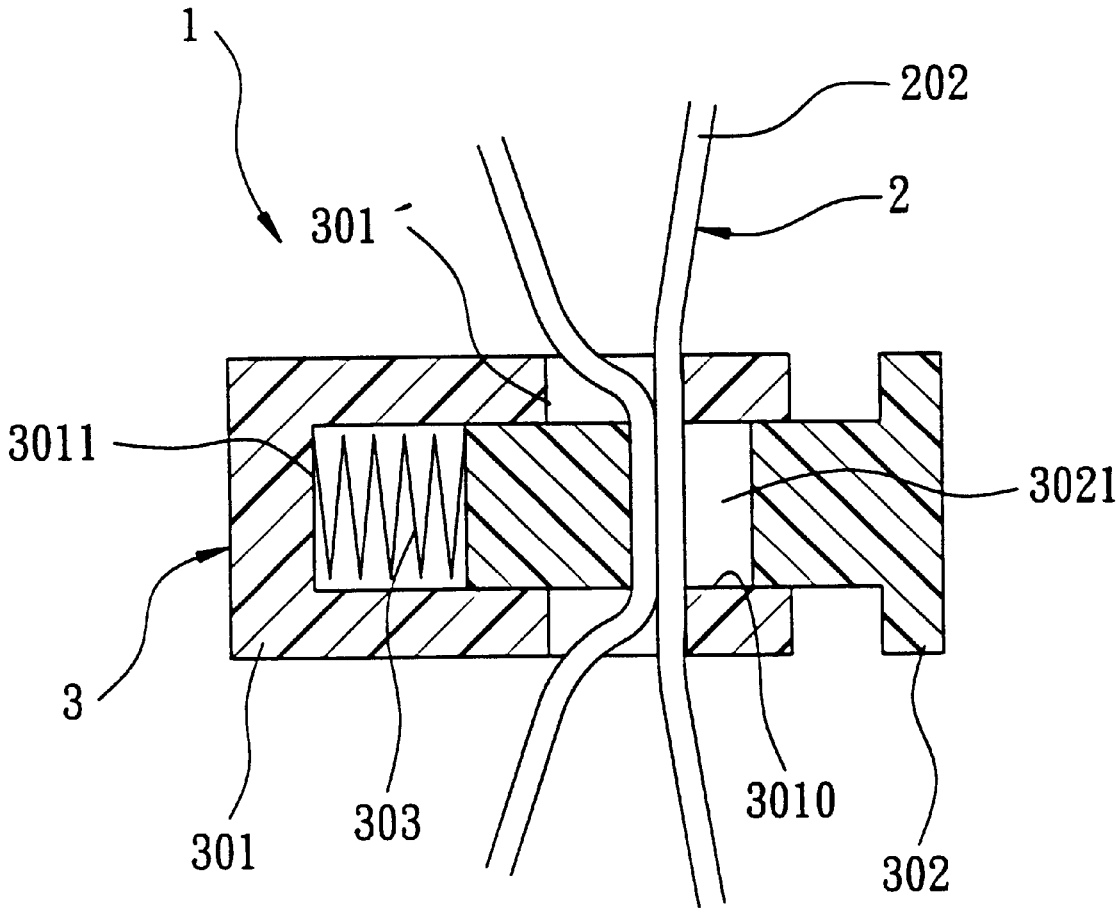
FIG. 2 PRIOR ART
FIG. 2 is a cross-sectional view of a clamp member of the conventional shoe lace device.

Before the present invention is described in greater detail, it should be noted that like elements are denoted by the same reference numerals throughout the disclosure.

Figure 3:
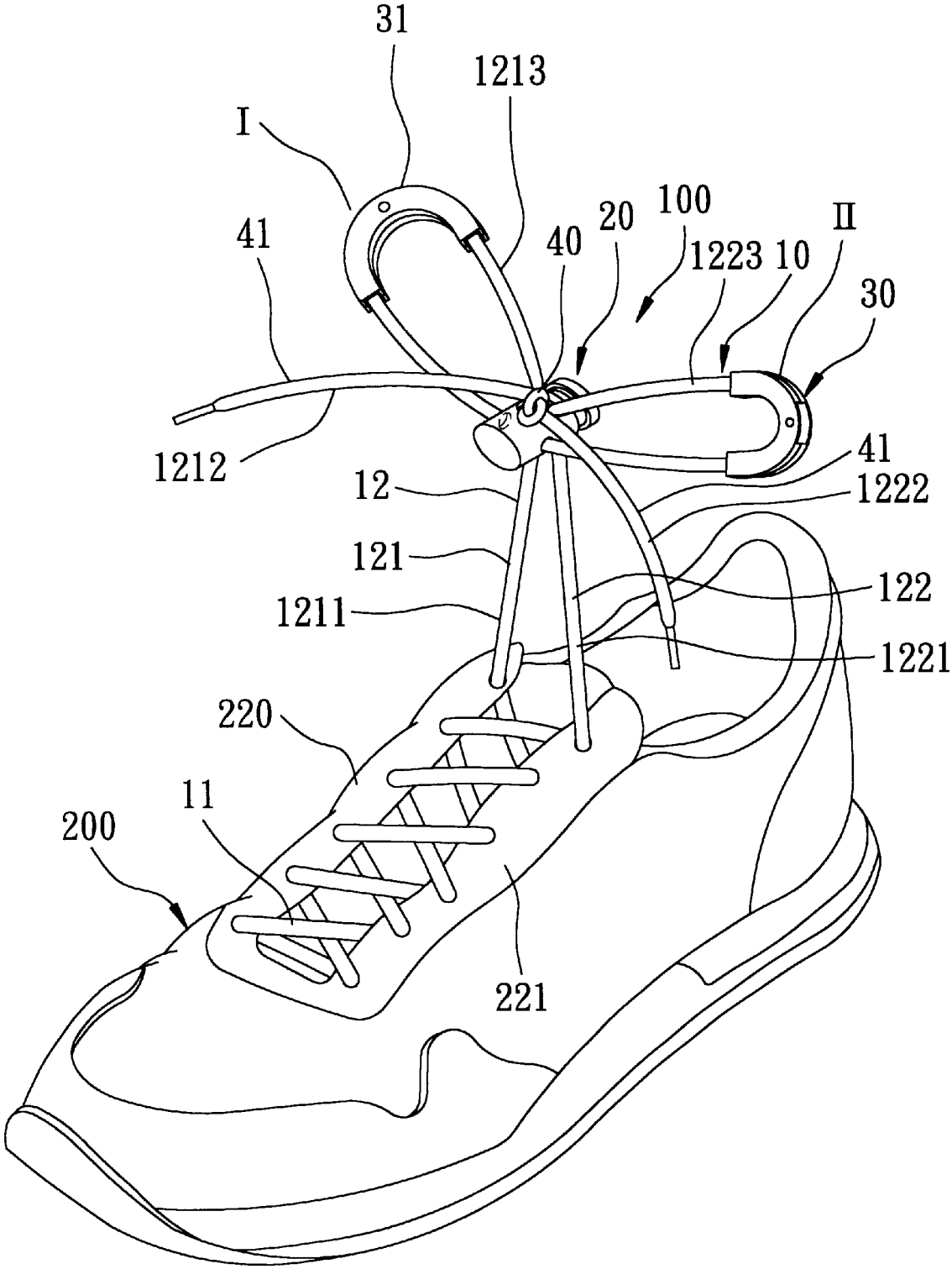
FIG. 3 is a perspective view of a shoe with the first preferred embodiment of a double-bow shoe lace device according to the present invention.

Referring to FIG. 3, the first preferred embodiment of a double-bow shoe lace device 100 according to the present invention is shown to be adapted for use with a shoe 200 having a pair of eyelet tabs 220, 221. The shoe lace device 100 comprises a shoe lace 10, a clamp member 20, a decorative knot 40, and a pair of pull members 30. The shoe lace 10 has first and second lace segments 11, 12. The first lace segment 11 is adapted to be strung on the shoe 200 so as to form a criss-cross pattern on the eyelet tabs 220, 221. The second lace segment 12 includes first and second lace portions 121, 122. Each of the first and second lace portions 121, 122 has a lower section 1211, 1221, an upper section 1212, 1222, and a medial section 1213, 1223 between the lower and upper sections 1211, 1221, 1212, 1222. The lower section 1211, 1221 of each of the first and second lace portions 121, 122 is connected to the first lace segment 11 so as to be adapted to be anchored on a respective one of the eyelet tabs 220, 221.

Figure 4:
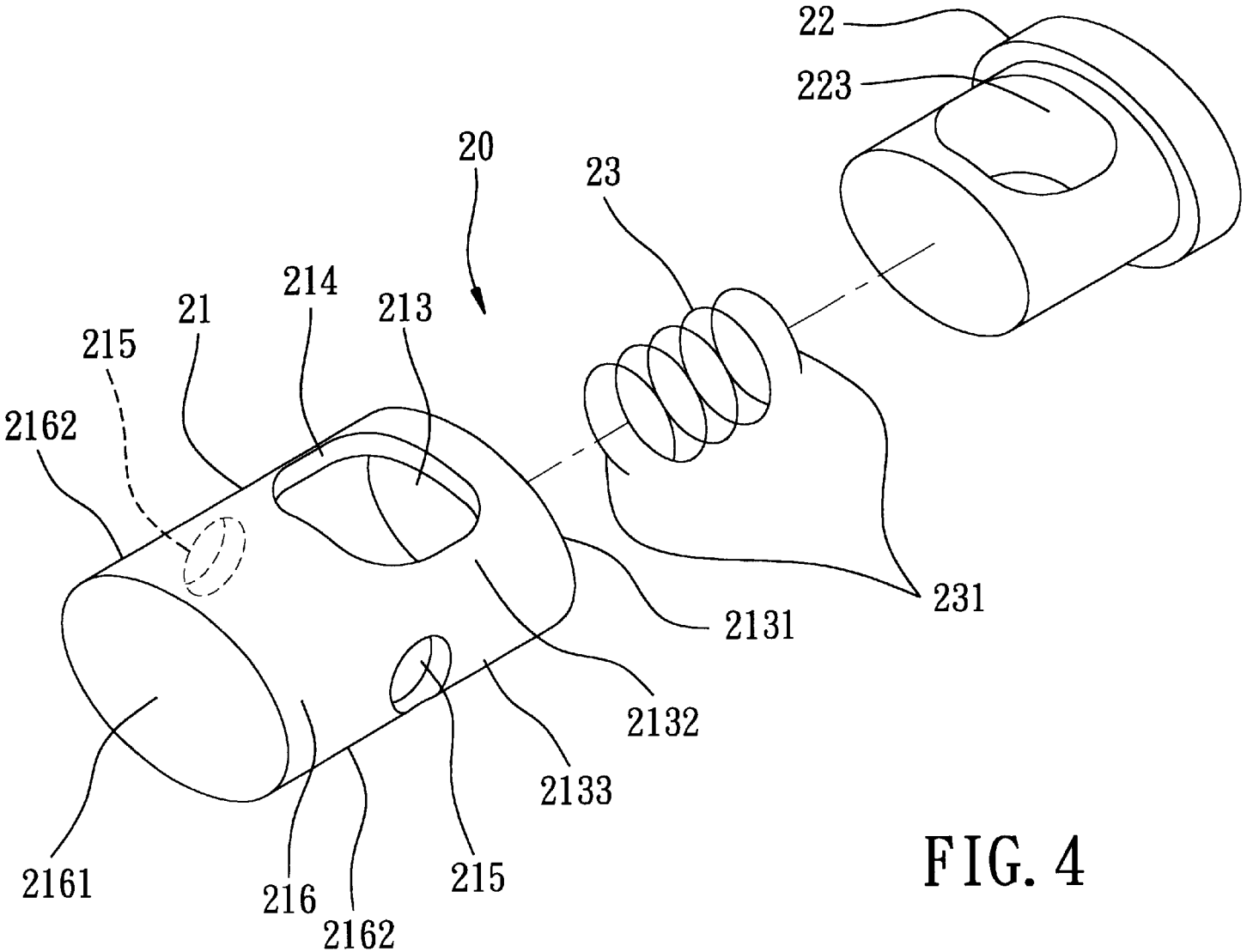
FIG. 4 is an exploded perspective view showing a clamp member of the first preferred embodiment.

With further reference to FIG. 4, the clamp member 20 is sleeved slidably on the medial sections 1213, 1223 of the first and second lace portions 121, 122, and includes an elongate casing 21, a clamping block 22, and a biasing member 23. The elongate casing 21 has a block receiving portion 213 and a spring receiving portion 216. The block receiving portion 213 has a front open end 2131, a top wall part 2132, and a bottom wall part 2133. Each of the top and bottom wall parts 2132, 2133 is formed with a first lace hole 214. The spring receiving portion 216 extends rearwardly from the block receiving portion 213, and has a rear closed end 2161 opposite to the front open end 2131 in a first direction. The top and bottom wall parts 2132, 2133 of the block receiving portion 213 are opposite to each other in a second direction transverse to the first direction. The spring receiving portion 216 further has a pair of lateral wall parts 2162 opposite to each other in a third direction transverse to the first and second directions. Each of the lateral wall parts 2162 is formed with a second lace hole 215.

The clamping block 22 is slidably received in the block receiving portion 213 of the casing 21, and is formed with a slot unit 223 that corresponds to the first lace holes 214 in the top and bottom wall parts 2132, 2133 of the block receiving portion 213.

Figure 6:
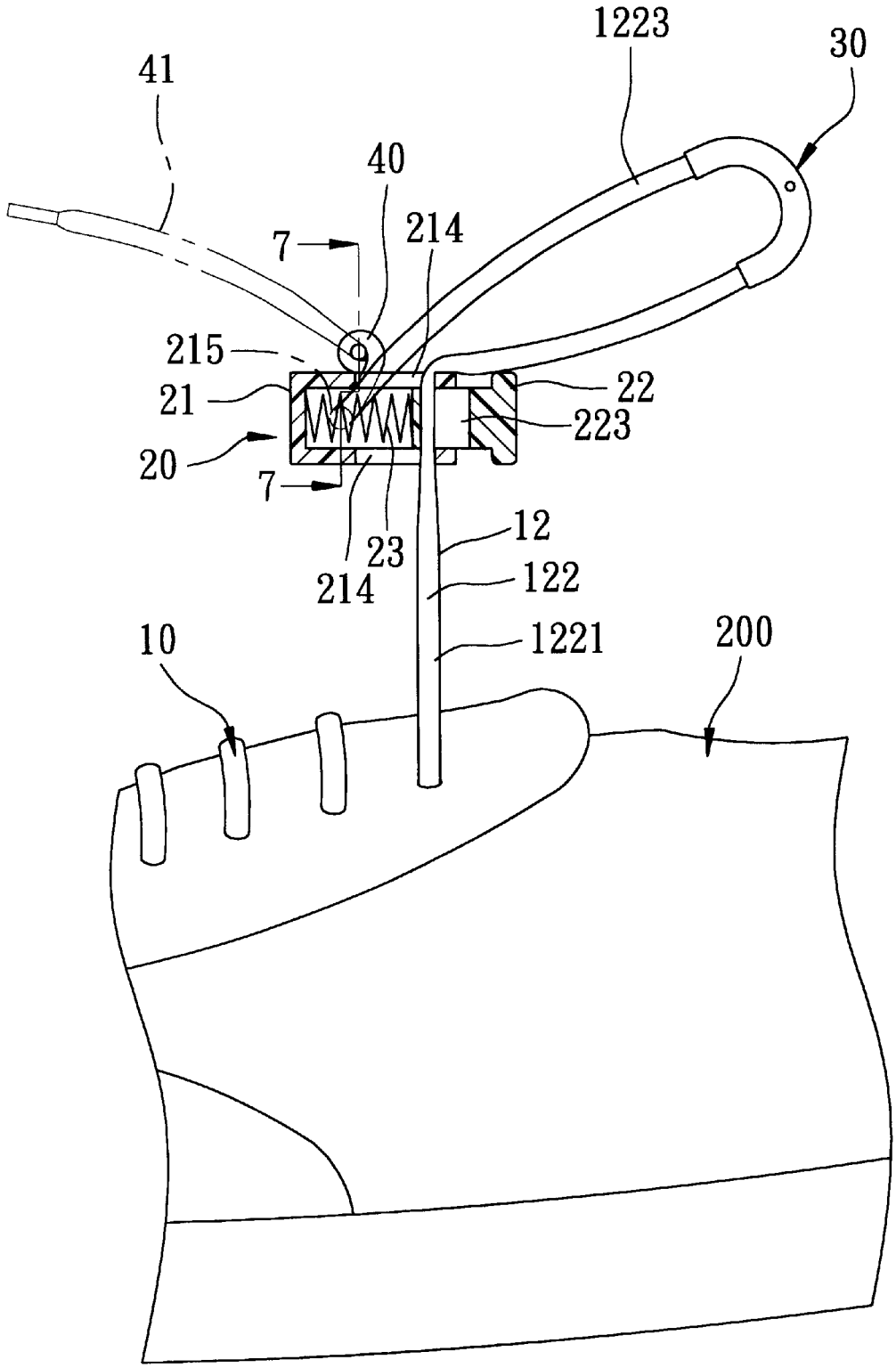
FIG. 6 is a fragmentary schematic partly sectional view illustrating how a medial section of a lace portion extends into lace holes in the clamp member to form a loop.

The biasing member 23, in the form of a coil spring, is disposed in the spring receiving portion 216 of the casing 21, has opposite ends 231 that abut respectively against the clamping block 22 and the rear closed end 2161 of the spring receiving portion 216, and biases the clamping block 22 outwardly of the front open end 2131 of the block receiving portion 213 so as to misalign the slot unit 223 from the first lace holes 214 in the top and bottom wall parts 2132, 2133, thereby clamping the medial sections 1213, 1223 of the first and second lace portions 121, 122 between the clamping block 22 and the casing 21, as best shown in FIG. 6.

Figure 8:
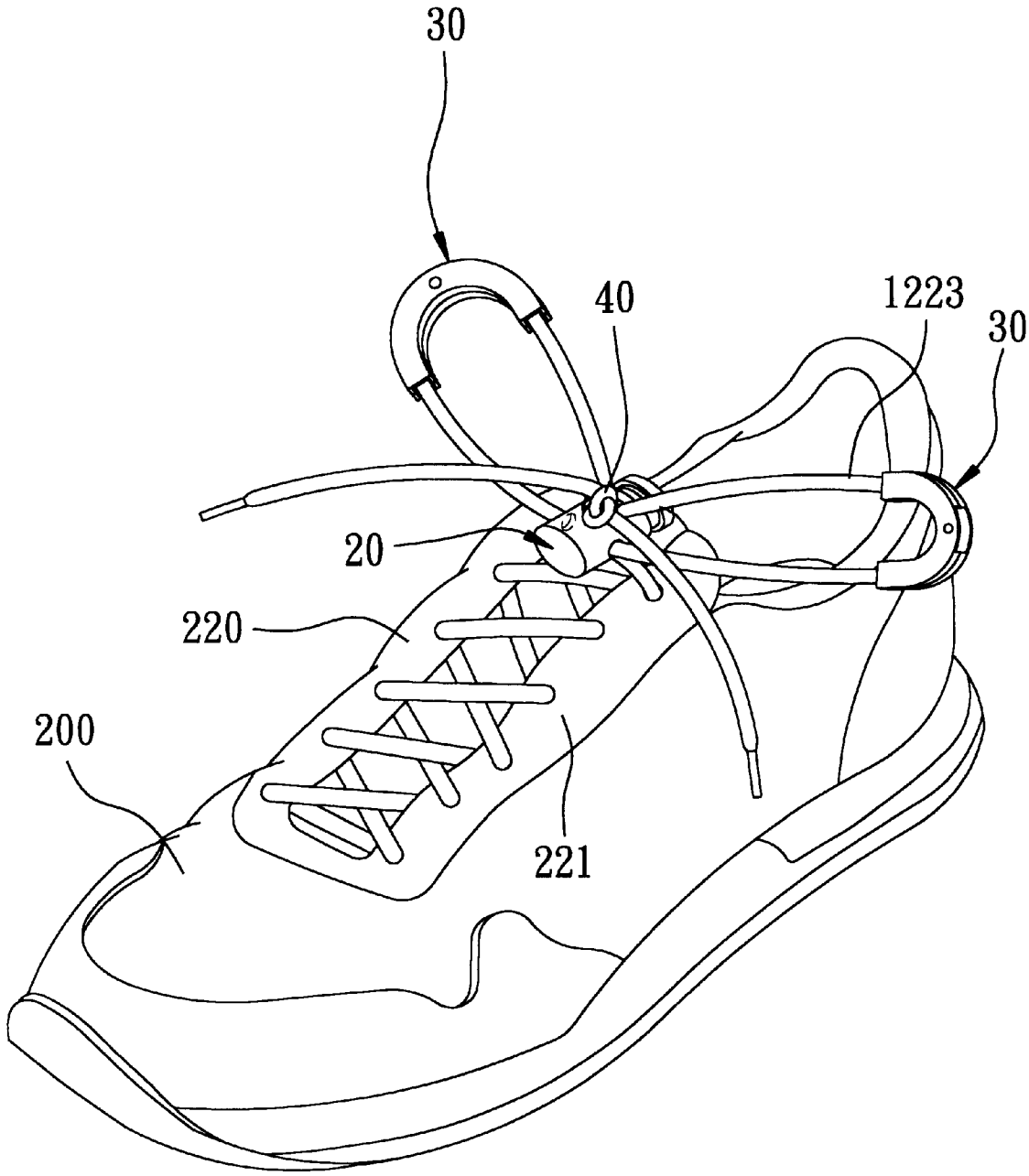
FIG. 8 is another perspective view showing the shoe with the double-bow shoe lace device of the first preferred embodiment in a tightened state.

Downward movement of the clamp member 20 along the medial sections 1213, 1223 of the first and second lace portions 121, 122 brings the lower ends 1211, 1221 of the first and second lace portions 121, 122 closer together for tightening the shoe 200 (see FIG. 8). Upward movement of the clamp member 20 along the medial sections 1213, 1223 of first and second lace portions 121, 122 permits the lower ends 1211, 1221 of the first and second lace portions 121, 122 to move away from each other for loosening the shoe 200 (see FIG. 3).

The medial section 1213, 1223 of each of the first and second lace portions 121, 122 extends from the lower section 1211, 1221 through the first lace hole 214 in the bottom wall part 2133, the slot unit 223 in the clamping block 22, and the first lace hole 214 in the top wall part 2132. The medial section 1213, 1223 of each of the first and second lace portions 121, 122 further extends into the spring receiving portion 216 of the casing 21 via the second lace hole 215 in one of the lateral wall parts 2162 and out of the casing 21 via the first lace hole 214 in the top wall part 2132 to connect with the knot 124, thus forming the medial section 1213, 1223 of each of the first and second lace portions 121, 122 into a loop (I), (II), as best illustrated in FIG. 6.

The upper sections 1212, 1222 of the lace portions 121, 122 are tied together to form the decorative knot 40 that is connected to the medial sections 1213, 1223 of the first and second lace portions 121, 122, that is disposed on the top wall part 2132 of the clamp member 20, and that has a pair of distal lace ends 41 extending therefrom. The lace portions 121, 122 are anchored to the casing 21, and the knot 40 is positioned on the casing 21 at this time.

Figure 5:
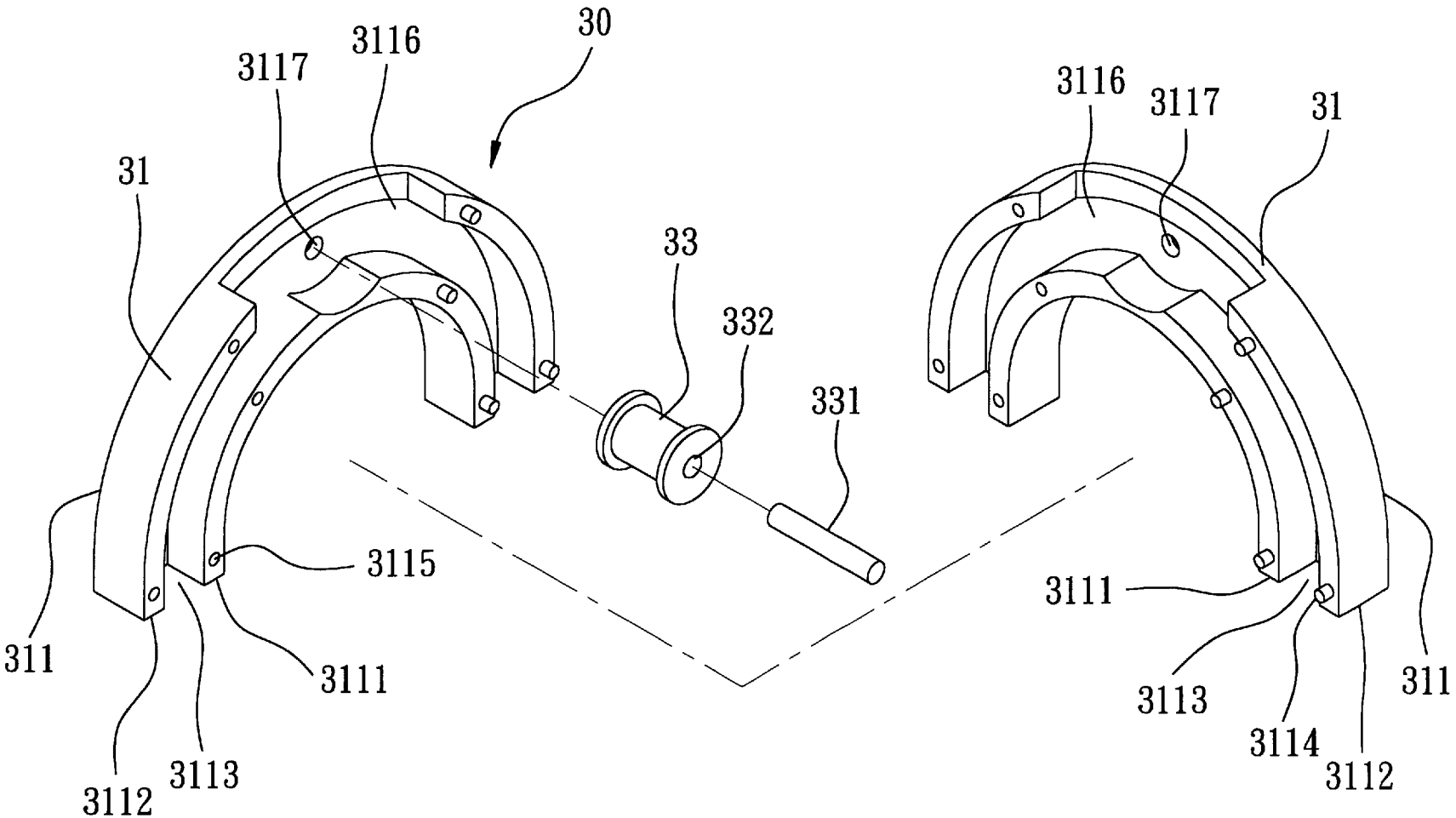
FIG. 5 is an exploded perspective view showing a pull member of the first preferred embodiment.
Figure 7:
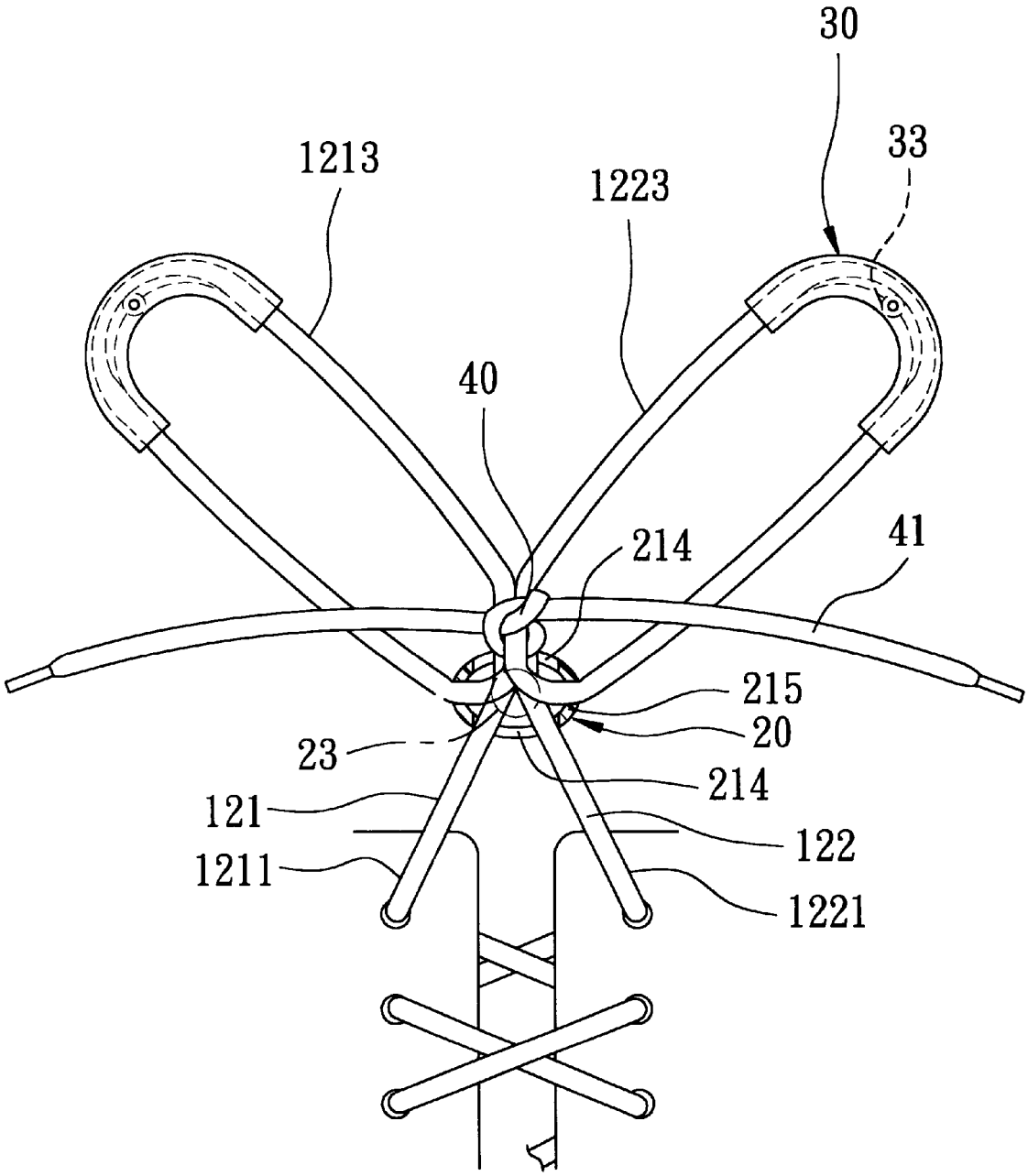
FIG. 7 is a fragmentary schematic partly sectional view illustrating how the medial sections of the lace portions are guided by the pull member.

Each of the pull members 30 is mounted slidably on the loop (I), (II) of a respective one of the medial sections 1213, 1223 of the first and second lace portions 121, 122, and includes a hollow guide member 31 and a guide roller 33. As shown in FIG. 5, the hollow guide member 31 includes a pair of curved plates 311. Each of the curved plates 311 has upright inner and outer walls 3111, 3112, a curved lace passage 3113 between the inner and outer walls 311, 312, and a lateral wall 3116 interconnecting the inner and outer walls 311, 312. The inner and outer walls 3111, 3112 are formed with a plurality of upright pins 3114 and pin holes 3115 that engage each other to form the guide member 31. Each of the lateral walls 3115 has a retaining hole 3117. The guide roller 33 is mounted rotatably in the lace passage 311 via a rod 331, and guides the sliding movement of the respective one of the medial sections 1213, 1223 of the first and second lace portions 121, 122 through the guide member 31, as best illustrated in FIG. 7. The rod 331 extends into a center hole 332 in the guide roller 33, and has opposing ends that engage respectively the retaining holes 3117 in the lateral walls 3116 to retain the guide roller 33 in the lace passage 311.

In use, when the pull members 30 are pulled apart, the loops (I), (II) of the medial sections 1213, 1223 become larger, forcing the clamp member 20 to slide downwardly along the lace portions 121, 122, so that the lower sections 1211, 1221 of the latter will be brought closer together at the same time for tightening the shoe 200, as shown in FIG. 8. The loops (I), (II) of the medial sections 1213, 1223 and the knot 40 with the distal lace ends 41 cooperate to form a double-bow configuration. It should be noted that it is not necessary that the knot 41 and the loops (I), (II) are connected to obtain the same result. Even if the second lace holes 215 are not formed in the casing 21 of the clamp member 20, as long as the lace portions 121, 122 are anchored to the casing 21 and the knot 40 is positioned on the casing 21, the double-bow configuration of the shoe lace device 100 can still be maintained.

To loosen the shoe 200, the clamping block 22 is operated to compress the biasing member 23, thereby aligning the slot unit 223 with the first lace holes 214 in the top and bottom wall parts 2132, 2133. At this time, by moving the clamp member 20 upwardly along the lace portions 121, 122, the lower sections 1211, 1221 of the latter can move away from each other for loosening the shoe 200, as shown in FIG. 3.

Therefore, the shoe 200 is not only easy to wear and remove, but also has an attractive appearance in view of the double-bow configuration of the shoe lace device 100.

Figure 9:
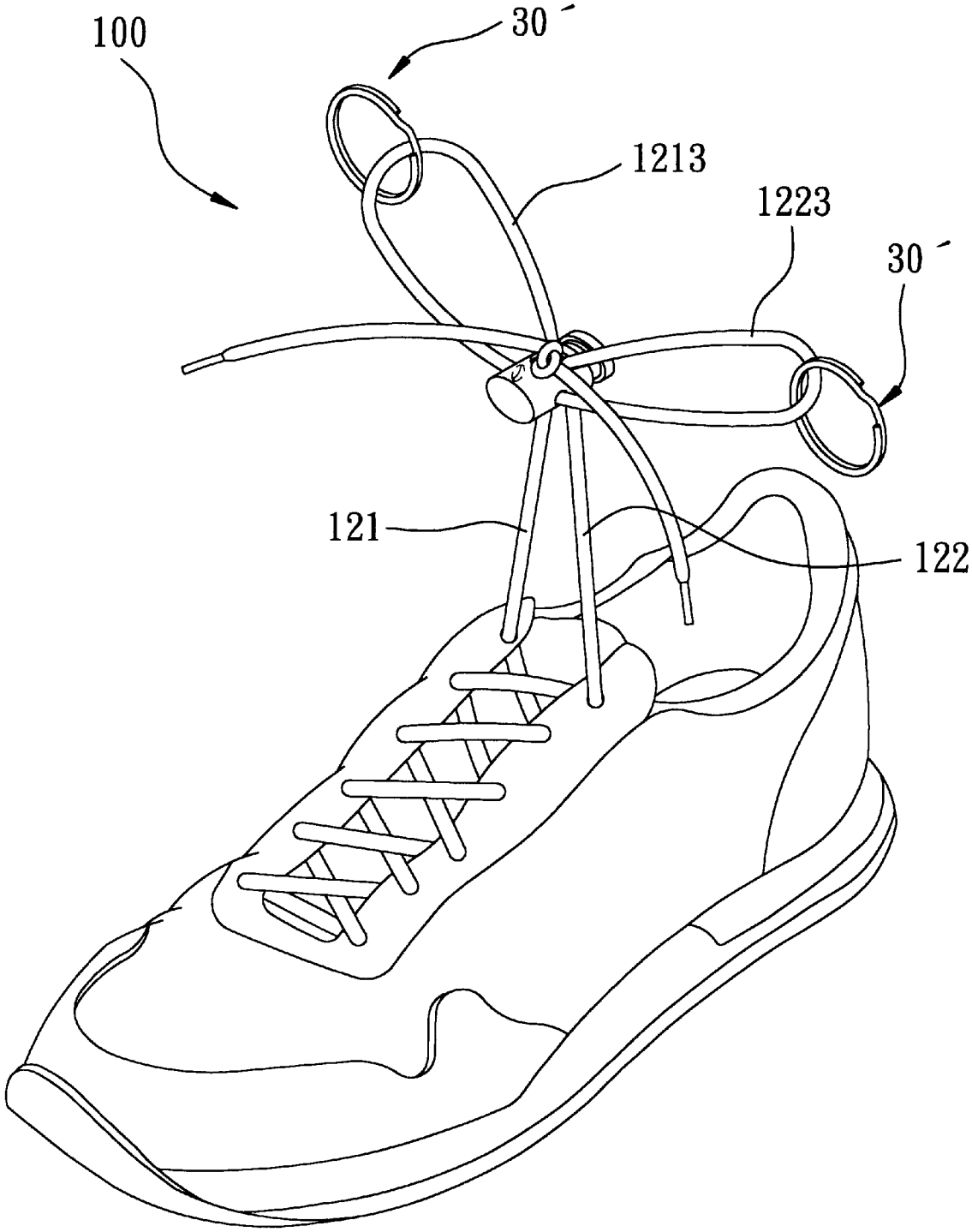
FIG. 9 is a perspective view illustrating a shoe with the second preferred embodiment of a double-bow shoe lace device according to the present invention.

FIG. 9 illustrates the second preferred embodiment of a double-bow shoe lace device 100 according to the present invention. Unlike the first preferred embodiment, each of the pull members 30' is formed as a ring having the respective one of the medial sections 1213, 1223 of the first and second lace portions 121, 122 extending therethrough.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A double-bow shoe lace device for a shoe with a pair of eyelet tabs, said shoe lace device comprising:

a shoe lace having first and second lace segments, said first lace segment being adapted to be strung on the shoe so as to form a criss-cross pattern on the eyelet tabs, said second lace segment including first and second lace portions, each of said first and second lace portions having a lower end connected to said first lace segment so as to be adapted to be anchored on a respective one of the eyelet tabs;

a clamp member sleeved slidably on said first and second lace portions, downward movement of said clamp member along said first and second lace portions bringing said lower ends of said first and second lace portions closer together for tightening the shoe, upward movement of said clamp member along said first and second lace portions permitting said lower ends of said first and second lace portions to move away from each other for loosening the shoe;

each of said first and second lace portions being anchored on said clamp member to form a pair of loops;

a decorative knot positioned on said clamp member and having a pair of distal lace ends that extend from said knot; and a pair of pull members, each of which is mounted slidably on a respective one of said loops, and each of which includes a hollow guide member formed with a curved lace passage, and a guide roller mounted rotatably in said lace passage for guiding sliding movement of the respective one of said loops through said guide member.

2. A double-bow shoe lace device for a shoe with a pair of eyelet tabs, said shoe lace device comprising:

a shoe lace having first and second lace segments, said first lace segment being adapted to be strung on the shoe so as to form a criss-cross pattern on the eyelet tabs, said second lace segment including first and second lace portions, each of said first and second lace portions having a lower section, an upper section, and a medial section between said lower and upper sections, said lower section of each of said first and second lace portions being connected to said first lace segment so as to be adapted to be anchored on a respective one of the eyelet tabs, said upper sections of said first and second lace sections being tied together to form a decorative knot and a pair of distal lace ends that extend from said knot; and a clamp member sleeved slidably on said medial sections of said first and second lace portions, said clamp member including an elongate casing having a block receiving portion with a front open end, and a spring receiving portion that extends rearwardly from said block receiving portion and that has a rear closed end opposite to said front open end in a first direction, said block receiving portion having top and bottom wall parts opposite to each other in a second direction transverse to the first direction, each of said top and bottom wall parts being formed with a first lace hole, said spring receiving portion having a pair of lateral wall parts opposite to each other in a third direction transverse to the first and second directions, each of said lateral wall parts being formed with a second lace hole, a clamping block slidably received in said block receiving portion of said casing, said clamping block being formed with a slot unit that corresponds to said first lace holes in said top and bottom wall parts of said block receiving portion, and a biasing member disposed in said spring receiving portion of said casing and having opposite ends that abut respectively against said clamping block and said rear closed end of said spring receiving portion, said medial section of each of said first and second lace portions extending from said lower section through said first lace hole in said bottom wall part, said slot unit in said clamping block, and said first lace hole in said top wall part, and further extending into said spring receiving portion of said casing via said second lace hole in one of said lateral wall parts and out of said casing via said first lace hole in said top wall part to connect with said knot, thus forming said medial section of each of said first and second lace portions into a loop, said biasing member biasing said clamping block outwardly of said front open end of said block receiving portion so as to misalign said slot unit from said first lace holes in said top and bottom wall parts, thereby clamping said medial sections of said first and second lace portions between said clamping block and said casing.

3. The double-bow shoe lace device of claim 2, further comprising a pair of pull members, each of which is mounted slidably on said loop of a respective one of said medial sections of said first and second lace portions.

4. The double-bow shoe lace device of claim 3, wherein each of said pull members includes a hollow guide member formed with a curved lace passage, and a guide roller mounted rotatably in said lace passage for guiding sliding movement of the respective one of said medial sections of said first and second lace portions through said guide member.

5. The double-bow shoe lace device of claim 3, wherein each of said pull members is formed as a ring having the respective one of said medial sections of said first and second lace portions extending therethrough.

* * * * *